US012780503B2

(12) United States Patent
Baker et al.

(10) Patent No.: US 12,780,503 B2
(45) Date of Patent: Nov. 3, 2026

(54) UNIVERSAL THREAD CLAMP

(71) Applicant: Nanodropper, Inc., Rochester, MN (US)

(72) Inventors: Elias Lee Baker, Rochester, MN (US); Mackenzie Andrews, Olympia, WA (US)

(73) Assignee: Nanodropper, Inc., Rochester, MN (US)

( * ) Notice: Subject to any disclaimer, the term of this patent is extended or adjusted under 35 U.S.C. 154(b) by 0 days.

(21) Appl. No.: 17/972,343

(22) Filed: Oct. 24, 2022

(65) Prior Publication Data

US 2023/0130906 A1 Apr. 27, 2023

Related U.S. Application Data

(60) Provisional application No. 63/271,307, filed on Oct. 25, 2021.

(51) Int. Cl.
*B65D 41/04* (2006.01)
*B65D 51/24* (2006.01)

(52) U.S. Cl.
CPC ..... *B65D 41/0471* (2013.01); *B65D 51/24* (2013.01); *B65D 2251/02* (2013.01); *B65D 2251/08* (2013.01)

(58) Field of Classification Search
CPC ..... B65D 41/0471; B65D 51/24; B65D 2251/02; B65D 2251/08; Y10T 24/1482; Y10T 24/1498; Y10T 292/205; Y10T 292/509
See application file for complete search history.

(56) References Cited

U.S. PATENT DOCUMENTS 4,457,445 A * 7/1984 Hanks ..... G09F 3/0323 222/153.07
4,557,024 A * 12/1985 Roberts ..... F16L 33/035 24/23 EE
4,844,270 A * 7/1989 Coffman ..... B29C 66/12423 220/288
5,195,561 A * 3/1993 Wilson ..... B60C 29/066 301/5.24
5,833,085 A * 11/1998 Valyi ..... B29C 66/54 215/44
5,911,367 A * 6/1999 McInerney ..... B65D 63/1072 24/17 AP (Continued)

FOREIGN PATENT DOCUMENTS

KR 20030093894 A 12/2003

OTHER PUBLICATIONS

International Search Report and Written Opinion issued for PCT/US2022/047608, dated Feb. 21, 2023.

*Primary Examiner* — James N Smalley
(74) *Attorney, Agent, or Firm* — Westman, Champlin & Koehler, PA; Amanda M. Prose

(57) ABSTRACT

A universal attachment for connecting to a first device having a threaded portion and allowing for attachment of a second, different device to the first device where the first and second devices do not have compatible threaded portions for connection is described herein. The universal attachment is directed to consumers wanting to attach an external device to a threaded neck of an existing device without needing to match the thread shape, size, or dimensions of the original device.

18 Claims, 5 Drawing Sheets

(56) References Cited

U.S. PATENT DOCUMENTS

| | | | | |
|---|---|---|---|---|
| 6,105,908 | A * | 8/2000 | Kraus | F16L 3/233 248/74.3 |
| 6,341,706 | B1 * | 1/2002 | Neuner | B65D 51/32 222/570 |
| 6,371,155 | B1 * | 4/2002 | Balocca | E03C 1/041 137/382 |
| 6,742,223 | B1 * | 6/2004 | Chang | H02G 3/32 24/30.5 R |
| 6,854,616 | B2 * | 2/2005 | Steffan | B65D 59/06 220/793 |
| 7,757,872 | B2 | 7/2010 | Ver Hage | |
| 8,273,061 | B2 | 9/2012 | McConnell et al. | |
| 8,568,074 | B2 | 10/2013 | Wrigley | |
| 10,384,839 | B2 | 8/2019 | Yamaguchi | |
| 11,247,834 | B2 | 2/2022 | Boulez | |
| 2003/0168456 | A1 | 9/2003 | Tomasella | |
| 2004/0146673 | A1 * | 7/2004 | Larsen | B29C 65/58 428/35.7 |
| 2010/0072214 | A1 | 3/2010 | Mullah | |
| 2012/0323221 | A1 | 12/2012 | Gallo et al. | |
| 2014/0190923 | A1 * | 7/2014 | Alpern | B65D 47/122 215/40 |
| 2015/0239621 | A1 * | 8/2015 | Averill | B65D 41/086 215/329 |
| 2015/0336724 | A1 | 11/2015 | Simonian et al. | |
| 2016/0016704 | A1 | 1/2016 | Garza | |

* cited by examiner

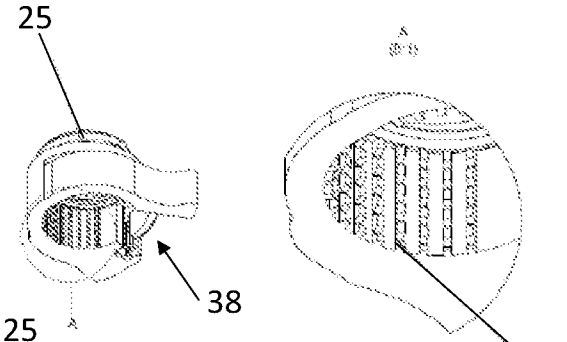
FIG. 8A
FIG. 8B
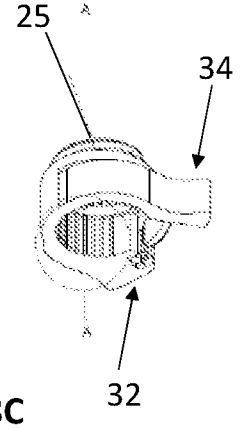
FIG. 8C
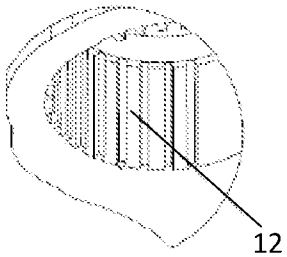
FIG. 8D

UNIVERSAL THREAD CLAMP

CROSS-REFERENCE TO RELATED APPLICATION

This application claims the benefit of and priority to U.S. provisional application Ser. No. 63/271,307, filed Oct. 25, 2021, the contents of which are hereby incorporated in their entirety.

FIELD OF THE INVENTION

The present invention relates to a universal clamp for a container having a threaded neck and more specifically to a universal clamp that allows a user to attach a different device to the container especially where the device and container do not have matching threaded portions for connection.

BACKGROUND

Threads can be found on the neck of various devices such as bottles, rods, hoses, pipes, etc. The threads vary in size and shape. To attach an external device onto the threads, the external device needs to have a compatible thread size. Without respective matching threads, the attachment of external devices is otherwise restricted.

SUMMARY

An aspect of the present disclosure relates to a universal threaded neck clamp having a main body with an arcuate length that provides an opening in the main body configured to receive an object therein and a strap extending outwardly from a first fixed connection with the main body. The main body further supports a strap connection mechanism on an end of the arcuate length opposite the position of the first fixed connection of the strap to the main body and wherein a terminal end of the strap is adjustably connectable to the strap connection.

The strap is a flexible strap such that a diameter of the opening in the main body is adjustable by way of connection between the strap and the strap connection mechanism to accommodate objects of a range of sizes therein.

The flexible strap comprises a surface having grooves or teeth thereon and configured to mate with a surface of the strap connection mechanism to lock the strap in connection with the strap connect mechanism.

The strap connection mechanism comprises a ratchet pawl for locking to the strap, the ratchet pawl comprising a flexure-like feature and a pawl to receive the teeth or grooves of the strap therein and to apply a constant force onto the strap for locking the strap in place.

The strap comprises a separated set of teeth or grooves thereon to temporarily engage a pawl of the strap connection mechanism prior to locking the strap into the strap connection mechanism.

In one or more embodiments, the clamp also includes one or a set of breakable plastic connections that attach to the strap body and the main body for providing a strap guide to connection with the main body, preventing movement of the strap before use, or combinations thereof.

The main body is produced by injection molding and further comprising a window or opening extending from a bottom surface to a top surface of the main body proximate the strap connection mechanism for removal of the main body from a mold during injection molding.

An inner surface of the main body comprises a regular or irregular surface geometry wherein elements of the surface geometry are deformable, conformable, or act to deform a surface of the object received within the opening of the main body and retain the object received therein with or without the use adhesives.

In one or more embodiments, an insert is provided for positioning in the opening of the main body between the main body and the object received therein to securely clamp the clamp to the object received therein. The insert comprises the regular or irregular surface geometry wherein elements of the surface geometry are deformable, conformable, or act to deform a surface of the object received within the opening of the main body and retain the object received therein with or without the use adhesives.

The insert is comprised of silicone.

The clamp also has an attachment surface on a top portion of the main body that allows an additional object to attach securely on to the main body.

The second object is a cap.

The opening in the main body has dimensions sufficient to allow a second object to be received in the opening with the first object to secure the second object to the first object within the opening of the clamp.

The perimeter of the main body comprises a surface geometry that provides two opposing user contact surfaces to allow the user to grip opposing ends of the main body and bring the opposing ends of the main body together and connect the strap to the strap connection mechanism with manual force.

The clamp also has a splined geometry on the main body and strap for ergonomic squeezing of ends of the clamp to engage the strap and lock around a first or second object within the opening.

Another aspect of the present disclosure relates to a universal clamp for securing an accessory to a device having a threaded end. The clamp has a main body comprising a first end, a second end and an arcuate length extending therebetween and an inner surface of the main body comprising one or more surface features spaced apart thereon. The first end of the main body comprises a first user interface surface on a perimeter surface thereof and a strap locking mechanism on an opposing surface thereof. The second end of the main body comprises a second user interface surface on a perimeter surface thereof and a strap extending from connection with an opposing surface thereof. The strap locking mechanism is configured to receive an end of the strap therein. The first and second user interface surfaces are manually movable towards one another to reduce a dimension of an opening in the main as a length of the strap connects to the strap locking mechanism.

The opening in the main body is formed by the closing of the first and second ends with the arcuate length therebetween wherein the arcuate length is configured to wrap around a surface of the device and a surface of the accessory and clamp the surface of the accessory between the main body and the device.

The main body further comprises an upper surface configured to couple to a second accessory.

The device is a container, and the accessory is a delivery nozzle for contents of the container.

The device is a container, and the accessory is a delivery nozzle for contents of the container and the second accessory is a cap.

BRIEF DESCRIPTION OF THE DRAWINGS

FIG. 8A is an isometric view of the universal thread clamp with the ribs deformed after being clamped onto a thread where the threaded device not shown for purposes of illustration clarity.

FIG. 8B is a detailed view of the deformed ribs after clamping on a thread where the threaded device is not shown for purposes of illustration clarity.

FIG. 8C is an isometric view of the ribs before deformation.

FIG. 8D is a detail view of the ribs before deformation.

DETAILED DESCRIPTION

Figure 1:
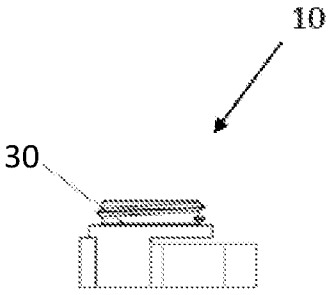
FIG. 1 is a front view of a universal thread clamp according to one or more embodiments described herein.

A universal attachment for connecting to a first device having a threaded portion and allowing for attachment of a second, different device to the first device where the first and second devices do not have compatible threaded portions for connection is described herein. The universal attachment is directed to consumers wanting to attach an external device to a threaded neck of an existing device without needing to match the thread shape, size, or dimensions of the original device.

The universal attachment is a universal thread clamp that allows for the connection of one or more accessory devices to an original device. The clamp is universal in that the clamp can be secured to nearly any original device having a threaded surface, threaded end, or threaded neck. The clamp may also be securely connected to an original device having a surface texture or geometry on an end or neck of the device. The universal attachment clamp may also be used to secure one or more accessory devices to the original device by way of clamping a surface of the original device between an inner surface of the clamp and the threaded or textured surface of the original device and/or by way of securing an accessory device to an outer and/or upper surface of the clamp. The clamp may thus have one or more surfaces configured for securely attaching to an accessory device concurrently with the clamp attached to an original device.

The clamp may be comprised of a hard plastic material and may be formed by injection molding or 3D printing for example. An inner dimension of the clamp may allow the clamp to be connected to various original devices having a threaded end or neck with a diameter of ½ inch to 3 inches, or in the range of 1 inch to 2 inches, for example.

The attachment described herein is a universal attachment or device as the attachment does not have threads that match existing external thread dimensions of threaded neck portions and thus can attach to various thread sizes and shapes. The attachment has an inner surface that engages an external threaded surface of a first device when the inner surface dimensions, for example, a circumference of the inner surface, is decreased by a mechanical force. The mechanical force may be a clamping force as ends of the inner surface are forced or squeezed together, whereby pressure is distributed around the external threaded features of the first device and the universal attachment then locks into place and maintains pressure around the threaded features of the first device.

The universal attachment comprises a body with external features that allow accessory devices to securely attach to the universal attachment to maintain or augment the original functions of the first device which the universal attachment secured to. The universal attachment includes a locking mechanism, examples of which include but are not limited to pawl and teeth, to prevent the universal attachment from losing the pressure that is exerted on the external threads of the first device to secure the invention onto the first device. The universal attachment may also have "ribs" or other surface geometry features in or on the inner body that conform to or deform to the shape of the threads of the first device. Additionally, or alternatively, the inner surface of the universal attachment has features configured to deform the threads of the device to match or mate with the shape of the features of the universal attachment. Further additionally, or alternatively, the universal attachment may further comprise an insert, for example, as a silicone insert, provided to fit between the inner surface of the universal attachment and the external threads of the first device to secure the universal attachment onto the first device. Additionally, or alternatively, the insert may have "ribs" or other surface geometry features thereon such that the universal attachment and/or the insert may have these surface geometry features.

The first device may be a container, bottle, rod, hose, pipe, or nearly any device having a threaded length, threaded end, or threaded neck for example.

In one embodiment, the universal attachment is a universal thread clamp that relates a variable size clamp that attaches to the threaded neck portion of an original device by exerting a distributed pressure force around the threaded neck of the original device. The clamp may attach to various thread sizes and shapes as well as various diameters of the threaded length. The clamp engages with the threads of the original device by squeezing together opposing ends of the clamp, whereby pressure is distributed around the threaded features of the original device. The clamp locks in place to maintain the pressure around the threaded features of the original device. The clamp comprises a main body that allows accessory devices to be attached to the clamp, where the accessory device may be those devices configured to maintain or augment the original functions of the original device. The clamp thus allows for operable connection of an accessory device to an original device, wherein the accessory device and the original device could not otherwise be connected as the device may not have compatible threaded portions or otherwise lack another means for connection to one another.

In one or more embodiments illustrated in the figures, the universal clamp 10 for securing an accessory to a device having a threaded end comprises a main body 30 having a first end 32, a second end 34 and comprising an arcuate length 36 extending therebetween. The clamp 10 has an inner surface of the main body that comprising one or more surface features 12 or textures spaced apart thereon. The first end 32 of the main body 30 comprises a first user interface surface 33 on a perimeter surface thereof and a strap locking mechanism 16 on an opposing surface thereof. The second end 34 of the main body 30 comprises a second user interface surface 35 on a perimeter surface thereof and a strap 38 extending from connection with an opposing surface thereof. The strap 38 extends from connection with the main body and may have teeth, grooves, or other geometry 18 thereon to connect with the strap locking mechanism 16.

The strap locking mechanism 16 is configured to receive an end of the strap 38 therein. The first and second user interface surfaces 33, 35 are manually movable towards one another to reduce a dimension of an opening 40 in the main body 30 as a length of the strap 38 connects to the strap locking mechanism 16.

The opening 40 in the main body 30 is formed by the closing of the first and second ends 32, 34 with the arcuate length therebetween wherein the arcuate length 36 is configured to wrap around a surface of the original device 14 and a surface of the accessory 20 and clamp the surface of the accessory 20 between the main body 30 and the device 14.

Figure 2:
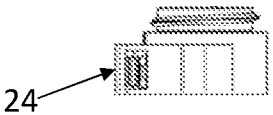
FIG. 2 is a back view of the universal thread clamp.
Figure 3A:
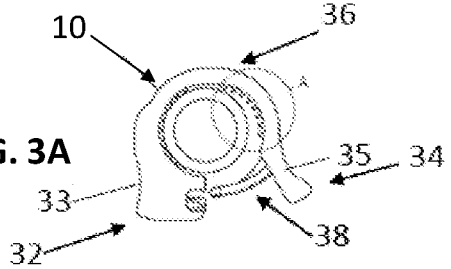
FIG. 3A is a bottom view of the universal thread clamp.
Figure 3B:
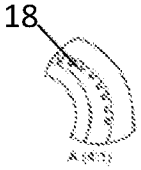
FIG. 3B is a detailed view of deformable ribs of the universal thread clamp.
Figure 4A:
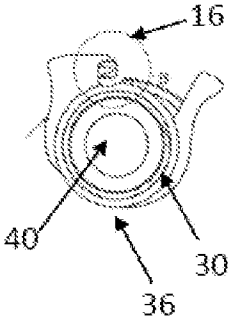
FIG. 4A is a top view of the universal thread clamp.
Figure 4B:
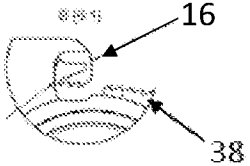
FIG. 4B is a detailed view of a ratchet pawl where it clamps onto strap teeth and illustrated a detailed view of the teeth on the strap and an opening for easier injection molding manufacturing processes.
Figure 5:
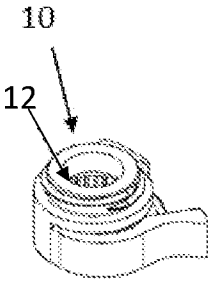
FIG. 5 is an isometric top view of the universal thread clamp.
Figure 6:
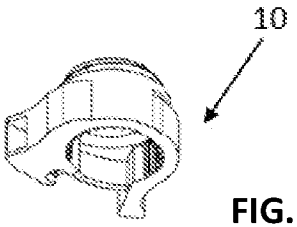
FIG. 6 is an isometric bottom view of the universal thread clamp.

Referring to the embodiment further illustrated in the figures, FIGS. 1-2 illustrate front and back view of the universal thread clamp 10. The inner surface of the thread clamp 10 may comprise a mechanism 12 for attachment to an original device 14. For example, as shown in FIGS. 3 and 3A, the mechanism 12 comprises deformable ribs on the inner surface of the thread clamp 10. The thread clamp also comprises a locking mechanism 16, which may be a ratchet pawl locking mechanism which can be seen in FIGS. 4 and 4A. In FIG. 4B, teeth of the strap 18 which engage with the ratchet pawl are illustrated. While the bottom of the clamp 10 is configured to connect to the original device 12, the top of the clamp 10 as shown in FIGS. 5 and 6 may be configured to secure to an external or accessory device.

Figure 7B:
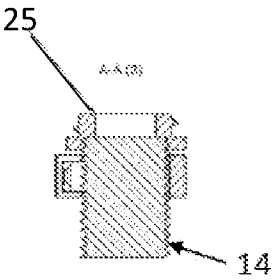
FIG. 7B is a cross-sectional view of the universal thread clamp clamped onto a threaded rod.
Figure 7A:
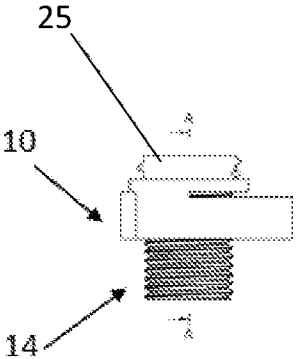
FIG. 7A illustrates the universal thread clamp being clamped onto a thread.
Figure 7C:
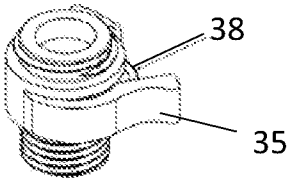
FIG. 7C is an isometric view of the universal thread clamp clamped onto a threaded rod.
Figure 10A:
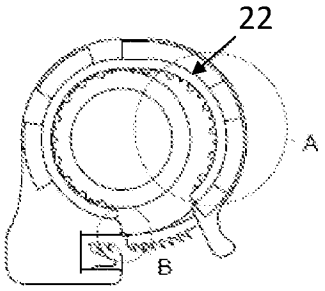
FIG. 10A is a detailed bottom view of one embodiment of many surface features of the silicone insert to help increase surface area contact between the universal thread clamp and a clamped device.
Figure 9:
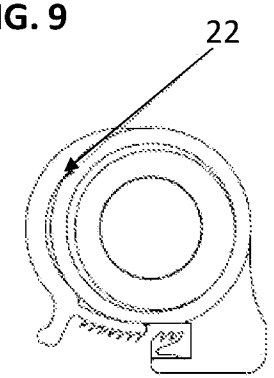
FIG. 9 is a top view of the universal thread clamp with an insert.

FIG. 7 shows an example of the universal thread clamp 10 that is clamped to the original device 14, which is a threaded rod. The universal thread clamp 10 comprises the ratchet and lock mechanism to prevent the universal thread clamp 10 from losing the pressure that is exerted onto the threads of the rod 14 to secure the universal thread clamp 10 onto the rod 14. Referring back to FIG. 1 as well as FIGS. 5-6, FIGS. 1, 5, and 6, the universal thread clamp 10 in the embodiment illustrated comprises the original device connection mechanism 12 which may be deformable ribs, or other geometry, or a silicone insert 22 that conforms to the shape of the threads to help keep the clamp secure onto the original device as illustrated in FIGS. 3A and 9A. As shown in FIGS. 9-10A, the silicone insert 22 may have an external surface geometry or topography which may include an adhesive coat on the surface of the insert 22, for example, on the ribs thereof to increase bonding between the insert and threads or similar surfaces. While the insert 22 illustrated is described as a silicone insert, the insert may be comprised of materials that may be conformable, deformable, malleable, or brittle but soft enough to be deformed by the OEM threads of the original device 14, a material such as material that is soft and malleable in the manner of silicone to conform to the OEM threads, or a material such as a plastic or resin that more rigid/hard than the OEM threads and instead deforms the OEM threads. It is further noted that in the embodiment where no insert is needed, the universal thread clamp may be comprised of one or more materials described above. The ribs or other surface geometry is provided to aid in providing a clamping grip to the object and may also resist or prevent unintended removal of the universal thread clamp 10 from the original device 14.

FIGS. 8 and 8A are examples of one embodiment of an original device connection mechanism such as deformable ribs after the universal thread clamp is clamped onto a thread of the original device. Referring back to FIGS. 2 and 6, the universal thread clamp 10 may also comprise a window or opening 24 to aid in the injection molding manufacturing process of the universal thread clamp 10 by allowing a part of the mold tool to eject out freely without the need of additional complex actions.

The universal thread clamp 10 may be provided in an unlocked or semi-locked position. The user will center and lower the clamp onto the original device body so that the clamp substantially or completely covers the threaded features on the original device. The user may then pinch the strap and ratchet/lock ends of the universal thread clamp together to engage the strap with the ratchet/lock mechanism, thereby applying pressure around the threads of the original device and locking the clamp in place. The rib features of the universal thread clamp may deform around the threads to increase the engagement of the clamp to the original device threads.

Figure 10C:
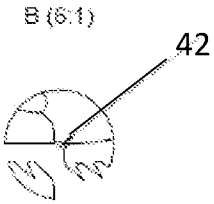
FIG. 10C is a detailed view of a breakaway feature.
Figure 10B:
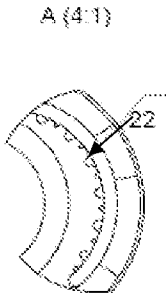
FIG. 10B a detailed view of a surface geometry of a silicone insert.

As shown in FIG. 10C, the universal thread clamp 10 may be provided with a breakaway feature 42 that prevents the accidental engagement of the locking mechanism. This feature is positioned to require manual force to break the breakaway feature 40 free and once removed, the locking mechanism can be engaged.

Figure 11B:
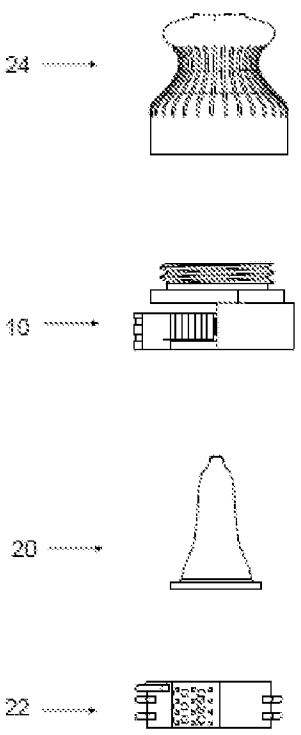
FIG. 11B is an exploded side view of the universal thread clamp and accessory device(s) for connecting thereto.
Figure 11A:
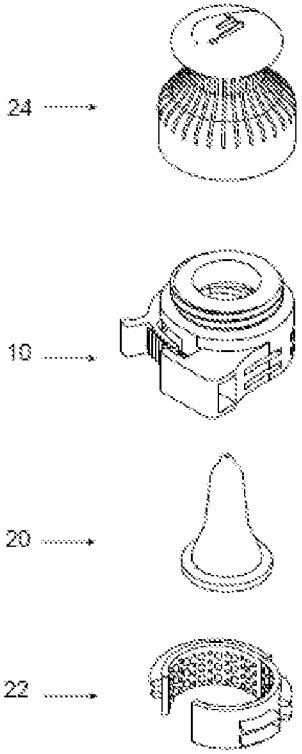
FIG. 11A is an exploded perspective view of a universal thread clamp and accessory device(s) for connecting thereto.

FIGS. 11A and 11B illustrate the universal thread clamp 10 as connectable to an accessory device 20 for attaching the accessory device 20 to an original device having a threaded neck. The universal clamp 10 is used with an original device attachment mechanism 12 that is an insert 22 having a surface geometry configured to hold a base of the accessory device 20 within the clamp 10 and the insert 22 connects with the inner surface of the clamp 10. An additional accessory device 24 is then connectable to the top 25 of the clamp 10 and may be a cap.

Although the present disclosure has been described with reference to preferred embodiments, workers skilled in the art will recognize that changes may be made in form and detail without departing from the spirit and scope of the disclosure.

The invention claimed is:

1. A universal clamp for threaded neck objects comprising:

a rigid main body having an arcuate length that provides an opening in the main body configured to receive a first object and a second object therein and an integral inner surface comprising an irregular, non-threaded, non-helical external surface geometry wherein elements of the external surface geometry are deformable to a shape of threads on the first and/or second objects such that the elements of the surface geometry conform to the threads and the portions therebetween to retain the first and second objects simultaneously with the clamp and prevent unintentional removal of the clamp from the first and second object, wherein the opening in the main body has dimensions sufficient to secure the second object to the first object within the opening of the clamp such that the first object is vertically aligned with and clamped to the second object; and a strap extending outwardly from a first fixed connection with the main body, wherein the main body further supports a strap connection mechanism on an end of the arcuate length opposite a position of the first fixed connection of the strap to the main body and wherein a terminal end of the strap is adjustably connectable to the strap connection mechanism.

2. The clamp of claim 1 wherein the strap is a flexible strap such that a diameter of the opening in the main body is adjustable by way of connection between the strap and the strap connection mechanism to accommodate objects of a range of sizes therein.

3. The clamp of claim 2 wherein the flexible strap comprises a surface having grooves or teeth thereon and configured to mate with a surface of the strap connection mechanism to lock the strap in connection with the strap connect mechanism.

4. The clamp of claim 3 wherein the strap connection mechanism comprises a ratchet pawl for locking to the strap, the ratchet pawl comprising a flexure-like feature and a pawl to receive the teeth or grooves of the strap therein and to apply a constant force onto the strap for locking the strap in place.

5. The clamp of claim 3 wherein the strap comprises a separated set of teeth or grooves thereon to temporarily engage a pawl of the strap connection mechanism prior to locking the strap into the strap connection mechanism.

6. The clamp of claim 1 and further comprising one or a set of breakable plastic connections that attach to the terminal end of the strap and the main body for providing a strap guide to connection with the main body and/or preventing movement of the strap before use.

7. The clamp of claim 1 wherein the main body is produced by injection molding and further comprising a window or opening extending from a bottom surface to a top surface of the main body proximate the strap connection mechanism for removal of the main body from a mold during injection molding.

8. The clamp of claim 1 wherein the elements of the surface geometry are conformable to the shape of threads or act to deform the threads of the first and second objects received within the opening of the main body and retain the first and second objects received therein with or without the use adhesives.

9. The clamp of claim 1 and further comprising an attachment surface on a top portion of the main body that allows a third object to attach securely on to the main body.

10. The clamp of claim 1 wherein a perimeter of the main body comprises a surface geometry that provides two opposing user contact surfaces to allow a user to grip opposing ends of the main body and bring the opposing ends of the main body together and connect the strap to the strap connection mechanism with manual force.

11. The clamp of claim 1 and further comprising a splined geometry on the main body and strap for ergonomic squeezing of ends of the clamp to engage the strap and lock around the first and second objects within the opening.

12. A universal clamp for securing a first accessory to a device having a threaded end comprising:

a rigid main body comprising a first end, a second end, an arcuate length extending therebetween, and an inner surface, the first end comprising a first user interface surface on a perimeter surface thereof and a strap locking mechanism on an opposing surface thereof and the second end comprising a second user interface surface on a perimeter surface thereof and a strap extending from connection with an opposing surface thereof, wherein the inner surface comprises one or more non-threaded external surface features spaced apart thereon that are deformable or conformable to a shape of threads on the device having a threaded end such that the non-threaded external surface features themselves conform to the threads and the portions therebetween and mechanically lock the universal clamp to the first accessory to prevent unintended removal of the universal clamp, wherein the strap locking mechanism is configured to receive an end of the strap therein, wherein the first and second user interface surfaces are manually movable towards one another to reduce a dimension of an opening in the main body as a length of the strap connects to the strap locking mechanism, wherein the opening in the rigid main body is formed by the closing of the first and second ends with the arcuate length therebetween, and wherein the arcuate length is configured to wrap around the threads of the device and a surface of the first accessory and clamp an end of the first accessory to the threaded end of the device.

13. The universal clamp of claim 12 wherein the main body further comprises a top surface configured to couple to a second accessory.

14. The universal clamp of claim 12 wherein the device is a container, and the first accessory is a delivery nozzle for contents of the container.

15. The universal clamp of claim 13 wherein the device is a container, the first accessory is a delivery nozzle for contents of the container, and the second accessory is a cap.

16. The clamp of claim 1 wherein the threads on the first and second objects do not mate.

17. The universal clamp of claim 12 wherein the clamp is configured to operably couple the device and the first accessory together wherein the device and the first accessory have different threaded surfaces that do not mate or wherein the first accessory does not have a threaded surface for connection to the device having the threaded end.

18. A universal threaded neck clamp comprising:

a rigid main body having an arcuate length that provides an opening in the main body configured to receive an object therein;

a flexible strap extending outwardly from a first fixed connection with the rigid main body, wherein the rigid main body further supports a strap connection mechanism on an end of the arcuate length opposite a position of the first fixed connection of the flexible strap to the main body and wherein a terminal end of the flexible strap is adjustably connectable to the strap connection mechanism; and a removable insert configured for positioning in the opening of the main body between the rigid main body and the object received therein, and wherein an inner surface of the insert comprises an external surface geometry comprising ribs that are conformable to a shape of threads and the portions between each thread on the object to prevent unintended removal of the clamp from the object received therein and wherein the insert is constructed from silicon, a conformable plastic or resin.

* * * * *